United States Patent [19]

Miwa et al.

[11] Patent Number: 4,770,084

[45] Date of Patent: Sep. 13, 1988

[54] PARALLEL SWASH PLATE TYPE FLUID MACHINES

[75] Inventors: Koji Miwa; Yasuhiro Higashihara; Takashi Onda; Tetsuo Kawasaki, all of Nagoya, Japan

[73] Assignee: Mitsubishi Jukogyo Kabushiki Kaisha, Tokyo, Japan

[21] Appl. No.: 37,250

[22] Filed: Apr. 10, 1987

[30] Foreign Application Priority Data

Apr. 23, 1986 [JP] Japan ..... 61-92330
May 31, 1986 [JP] Japan ..... 61-82811[U]

[51] Int. Cl.[4] ..... F01B 13/04
[52] U.S. Cl. ..... 91/501; 29/157.1 R
[58] Field of Search ..... 91/503, 499, 498, 501; 29/157.1 R

[56] References Cited

U.S. PATENT DOCUMENTS 1,648,000 11/1927 Lee ..... 91/503
2,229,715 1/1941 Zimmermann ..... 91/503
2,381,910 8/1945 Joy ..... 91/998
3,079,869 3/1963 Porcell ..... 91/503
3,353,450 11/1967 Killick et al. ..... 91/503
3,602,105 8/1971 Slusher ..... 91/501
3,918,493 11/1975 Tobias ..... 29/157.1 R

FOREIGN PATENT DOCUMENTS 128658 8/1948 Australia ..... 91/499
48207 7/1982 Japan ..... 91/503

*Primary Examiner*—William L. Freeh
*Attorney, Agent, or Firm*—Wenderoth, Lind & Ponack

[57] ABSTRACT

A parallel swash plate type fluid machine includes a barrel which is rotatable integrally with a rotary shaft, a plurality of cylinder sections directed in the axial direction and opening respectively on the opposite sides of the barrel, pistons fitted in the respective cylinder sections and capable of projecting on the opposite sides of the barrel, and a pair of swash plates for restraining strokes of the pistons provided in a mutually parallel alignment on the opposite sides of the barrel. Parts communicate with respective fluid chambers in the plurality of cylinder sections and have inlet sides connected with each other through a twisted flow passageway and have outlet sides connected with each other through another twisted flow passageway.

3 Claims, 4 Drawing Sheets

FIG. 7(A')

FIG. 8(B')
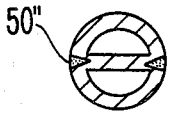
FIG. 8(A)
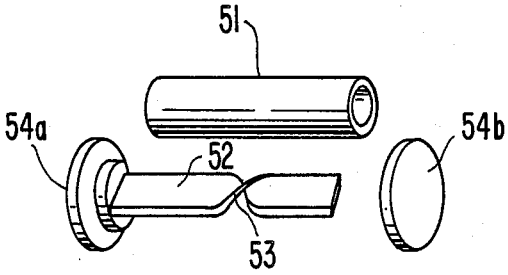
FIG. 8(B)
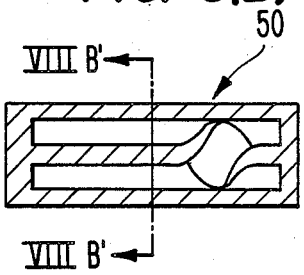
FIG. 9
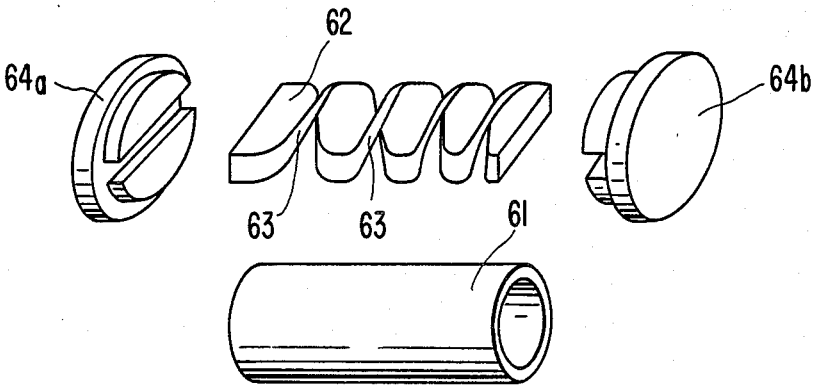

PARALLEL SWASH PLATE TYPE FLUID MACHINES

BACKGROUND OF THE INVENTION

1. Field of the Invention

The present invention relates to fluid machines, that is, fluid pumps or fluid motors having parallel swash plates (throughout the specification and claims, fluid pumps and fluid motors are generally called "fluid machines").

2. Description of the Prior Art

Heretofore, nonparallel swash plate type pumps (or motors) as shown in FIG. 10 have been widely used.

The illustrated nonparallel swash plate type pump is provided with a cylindrical barrel 7 which can rotate integrally with a rotary shaft 8*a* within a casing 9, and in the barrel 7 are formed two cylinders 3 which communicate the opposite sides of the barrel 7 with each other.

Into openings at the opposite ends of each of these cylinders 3 are liquid-tightly inserted pistons 1*a* and 1*b*, and each cylinder 3 communicates with the inner circumference of the barrel 7 through a port 10.

Also, into the barrel 7 is inserted a valve shaft 4 which is fixedly secured to the casing 9, and slide surfaces between the valve shaft 4 and the inner circumference of the barrel 7 are maintained liquid-tight.

In this valve body 4 are formed two flow passageways 5 and 6 directed in the axial direction as shown in FIG. 11, and these flow passageways 5 and 6 respectively communicate with ports 15 and 16 opening at the outer circumference of the valve shaft 4.

In FIG. 10 and FIG. 11, the valve shaft 4 is shown as being rotated by 90° so that construction of passageways 5 and 6 is easily illustrated.

These ports 15 and 16 have a sector-shaped cross-section along the outer circumference of the valve shaft 4 as shown in FIG. 11, and they are formed at such positions on the slide surface between the barrel 7 and the valve shaft 4 that they can communicate with the above-mentioned ports 10.

As the barrel 7 rotates, each above-described cylinder 3 communicates alternately with the flow passageway 5 and with the flow passageway 6.

On the other hand, on the opposite sides of the barrel 7, cams 2*a* and 2*b* having inclined surfaces 2*c* and 2*d*, respectively, are fixedly secured to the inner surfaces of the casing 9, these inclined surfaces 2*c* and 2*d* are formed symmetrically to each other with respect to a transverse plane 2*e* shown in FIG. 10, and the tip end portions of the pistons 1*a* and 1*b* butt against the inclined surfaces 2*c* and 2*d*, respectively. It is to be noted that the pistons 1*a* and 1*b* are pressed against the inclined surfaces 2*c* and 2*d* by biasing means (not shown), and thereby a butting condition between the tip end portions 1*a* and 1*b* and the inclined surfaces 2*c* and 2*d* can be always maintained.

Owing to the above-mentioned construction, if the rotary shaft 8*a* is driven in rotation by driving means (not shown), then the barrel 7 also rotates in association with the rotary shaft 8*a*, and hence the pistons 1*a* and 1*b* each of cylinder 3 having their tip end portions held in contact with the inclined surfaces 2*c* and 2*b* will operate so as to extend and contract as a unit.

During a suction step when the pistons 1*a* and 1*b* project outwardly toward the opposite sides of the barrel 7, the cylinder 3 communicates with the flow passageway 5 through the port 10 and the port 15, and thereby liquid such as oil is sucked from the flow passageway 5 into the cylinder 3.

On the other hand, in an exhaust step when the pistons 1*a* and 1*b* are retracted towards the inside of the barrel 7, the cylinder 3 communicates with the flow passageway 6 through the port 10 and the port 16, and thereby the above-described liquid is exhausted from the cylinder 3 to the flow passageway 6.

It is to be noted that the above-described nonparallel swash plate type pump apparatus can be used also as a hydraulic motor, because the rotary shaft 8*a* would be rotated by making liquid flow into the cylinder 3 through the flow passageway 5 by means of a hydraulic pump not shown.

However, in the above-described nonparallel swash plate type fluid machine, since the volumes of liquid retained within the two cylinders 3 are different from each other, the position of the center of gravity of the barrel 7 would deviate from a rotational center axis 8*b*. Thus since barrel 7 rotates at a very high speed when the fluid machine operates as a pump, a large vibration would occur due to the eccentricity of the center of gravity.

Hence, a parallel swash plate type fluid machine in which opposed inclined surfaces of cams are formed parallel to each other has been proposed, and in this proposed fluid machine the pair of pistons 1*a* and 1*b* shown in FIG. 10 would operate assymmetrically with respect to the plane 2*e*, and hence it is necessary to divide the cylinder 3 into two cylinder sections.

Then, one of the two cylinder sections would be connected to the inlet side port formed in the valve shaft, while the other cylinder section would be connected to the outlet side port, and there is a problem with respect to means for connecting the inlet side ports to each other and connecting the outlet side ports to each other within the valve shaft.

SUMMARY OF THE INVENTION

One object of the present invention is to resolve the above-described problem in such parallel swash plate type fluid machines.

According to one feature of the present invention, in a parallel swash plate type fluid machine in which a plurality of cylinder sections directed in the axial direction and opening respectively on the opposite sides of a barrel are provided in the barrel that is rotatable integrally with a rotary shaft, there are provided pistons fitted in the cylinder sections and capable of projecting respectively on the opposite sides of the barrel, and a pair of swash plates for restraining strokes of the pistons are provided in a mutually parallel alignment. ports communicating with the respective fluid chambers in the plurality of cylinder sections have inlet sides connected with each other through a twisted flow passageway and have outlet sides connected with each other through another twisted flow passageway.

According to another feature of the present invention, in the above-featured fluid machine, there are provided twisted flow passageways formed by accommodating a strip-like partition wall that is twisted at its middle portion within an outer cylinder to extend in the axial direction, hollow spaces on the opposite sides of the partition wall form an inlet flow passageway and an outlet flow passageways, respectively.

In the above-described parallel swash plate fluid machine according to the present invention, as the above-mentioned barrel rotates, the strokes of the above-described pistons are restrained by the pair of swash plates, fluid flows into the above-mentioned fluid chambers through the inlet side ports connected with each other via the twisted flow passageway, and fluid flows out of the above-mentioned fluid chambers through the outlet side ports connected with each other via the twisted flow passageway.

According to the present invention, owing to the above-mentioned simple structure of the inlet side flow passageway and the outlet side flow passageway for fluid in a parallel swash plate type fluid machine, upon operation of the fluid machine, vibrations accompanying high speed rotation of the barrel can be greatly reduced, and hence not only can environment noise be suppressed, but also working efficiency of the fluid machine can be improved.

Furthermore, according to the present invention, owing to the simple construction of the twisted flow passageways, difficult operation such as drilling twisted bores in a circular rod or twisting a circular rod having straight bores preliminarily drilled therein becomes unnecessary, and twisted flow passageways can be manufactured easily and precisely by a joining process such as soldering, brazing, diffusion joining, high energy beam welding, etc., or a casting process. Therefore, the present invention is industrially very useful.

The above-mentioned and other objects, features and advantages of the present invention will become more apparent by reference to the following description of preferred embodiments of the invention taken in conjunction with the accompanying drawings.

BRIEF DESCRIPTION OF THE DRAWINGS

In the accompanying drawings:

FIG. 4(*b*) a transverse cross-sectional view of the thereof;

FIGS. 8(A), 8(B) and 8(B') are schematic perspective and cross-sectional views showing a process for making the valve shaft having twisted flow passageways as in FIG. 5 by a high energy beam welding process;

FIG. 9 is a schematic perspective view showing the case where a large number of twists are applied to a partition wall between the twisted flow passageways in FIG. 5;

DESCRIPTION OF THE PREFERRED EMBODIMENT

Figure 1:
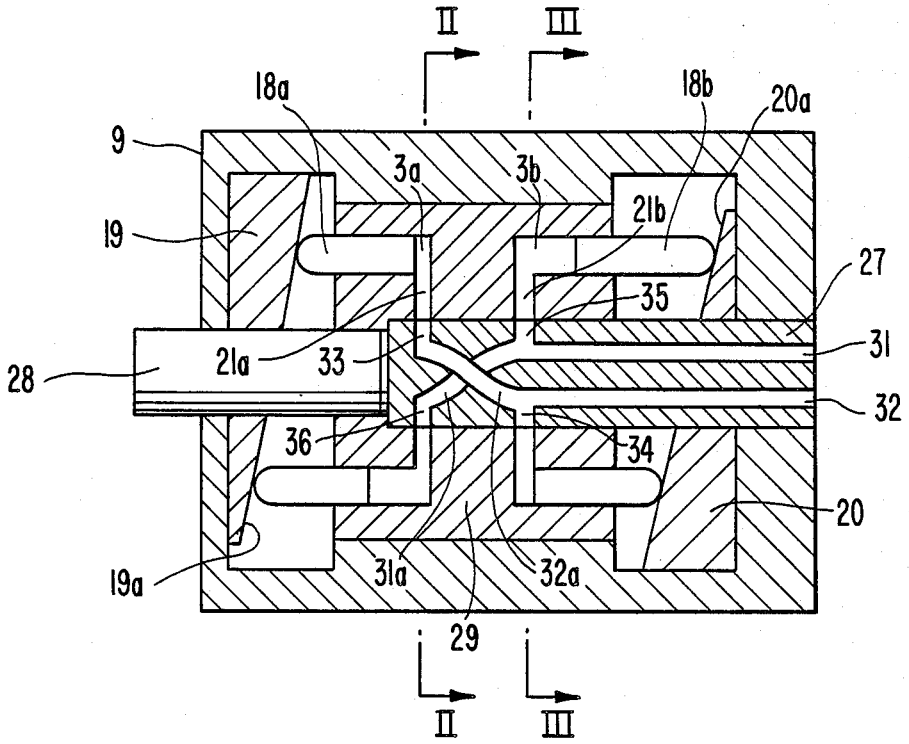
FIG. 1 is a longitudinal cross-sectional view illustrating a parallel swash plate type pump apparatus which forms one preferred embodiment of the present invention.

Referring now to FIG. 1, within a casing 9 is provided a cylindrical barrel 29 that is rotatable integrally with a rotary shaft 28, and two pairs of cylinder sections 3*a* and 3*b* opening on the opposite sides of the barrel 29 are formed in the barrel 29.

Pistons 18*a* and 18*b* are liquid-tightly fitted into cylinder sections 3*a* and 3*b* from openings at the opposite ends of the barrel 29, and the respective cylinder sections 3*a* and 3*b* communicate with the inner circumference of the barrel 29 through ports 21*a* and 21*b*, respectively.

Also, within the barrel 29 is inserted a valve shaft 27 that is fixedly secured to the casing 9, and the slide surface between the valve shaft 27 and the inner circumference of the barrel is maintained liquid-tight.

Figure 3:
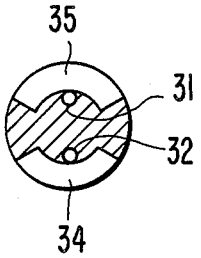
FIG. 3 is another transverse cross-section view of the valve shaft taken along line III—III in FIG. 1 as viewed in the direction of the arrows.

In this valve shaft 27 are formed two flow passageways 31 and 32 directed in the axial direction, and these flow passageways 31 and 32 include respective first length portions communicating with an inlet side port 35 and an outlet side port 34, respectively, opening at the outer circumference of the valve shaft 27 as shown in FIG. 3.

Furthermore, the inlet side port 35 is connected to an inlet side port 36 opening at the outer circumference of the valve shaft 27 through a twisted or inclined flow passageway 31*a*, and the outlet side port 34 is connected to an outlet side port 33 opening at the outer circumference of the valve shaft 27 through another twisted or inclined flow passageway 32*a*.

Figure 2:
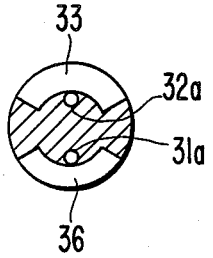
FIG. 2 is a transverse cross-sectional view of a valve shaft taken along line II—II in FIG. 1 as viewed in the direction of the arrows

The above-described inlet side ports 35 and 36 and outlet side ports 33 and 34 each have a sector-shaped cross-section along the outer circumference of the valve shaft 27 as shown in FIGS. 2 and 3, and they are formed at such axial positions that they can communicate with the above-described ports 21*a* and 21*b* at the slide surface between the barrel 29 and the valve shaft 27.

In FIG. 1, FIG. 2 and FIG. 3, the valve shaft 27 is shown as being rotated by 90° in order to easily illustrate the passageways 31 and 32.

On the opposite axial ends of the barrel 29, cams 19 and 20 having inclined surfaces 19*a* and 20*a*, respectively, are fixedly secured to the inside of the casing 9. Inclined surfaces 19*a* and 20*a* are formed so as to be parallel to each other, and the tip end portions of the pistons 18*a* and 18*b* butt against the inclined surfaces 19*a* and 20*a*, respectively. It is to be noted that the pistons 18*a* and 18*b* are pressed against the inclined surfaces 19*a* and 20*a*, respectively, by biasing means (not shown) so that a contact condition between the tip end portions of the pistons 18*a* and 18*b* and the inclined surfaces 19*a* and 20*a* can be always maintained.

Since the illustrated embodiment is constructed as described above, when the rotary shaft 28 is driven in rotation by driving means (not shown), the barrel 29 also rotates with the rotary shaft 28, and hence the pistons 18*a* and 18*b* having their tip portions held in contact with the inclined surfaces 19*a* and 20*a* operate so as to expand and contract as a unit.

In the phase when a given piston 18*a* retracts into its cylinder section 3*a* and corresponding piston 18*b* projects from its cylinder section 3*b*, the cylinder section 3*a* communicates with the flow passageway 32 through the respective port 21*a*, the outlet side port 33 and the twisted flow passageway 32*a*, and thereby liquid such as oil is exhausted from the cylinder section 3*a* to the flow passageway 32. In addition, the corresponding cylinder section 3*b* communicates with the flow passageway 31 through the respective port 21*b* and the inlet side port 35, and thereby the same amount of liquid is sucked from the flow passageway 31 into the cylinder section 3*b*.

Whereas, in the phase when a given piston 18*a* projects from its cylinder section 3*a* and the corresponding piston 18*b* retracts into its cylinder section 3*b*, the cylinder section 3*a* communicates with the flow passageway 31 through the respective port 21*a*, the inlet side port 36 and the twisted flow passageway 31*a*, and thereby liquid such as oil is sucked from the flow passageway 31 into the cylinder section 3*a*. In addition, the corresponding cylinder section 3*b* communicates with the flow passageway 32 through the respective port 21*b* and the outlet side port 34, and thereby the same amount of liquid is exhausted into the flow passageway 32 from the cylinder section 3*b*.

Thus, in the above-described parallel swash plate type pump apparatus, liquid is sucked from the flow passageway 31 and the same amount of liquid is exhausted from the passageway 32. During operation, the sums of the volumes of the liquid held within the cylinder sections 3*a* and 3*b* in the respective pairs of cylinder sections are equal to each other, hence the position of the center of gravity of the barrel 29 is maintained on the rotational center axis, and therefore, even if the barrel 29 rotates at a high speed, generation of large vibration can be prevented.

It is to be noted that the rotary shaft 28 would be rotated by making liquid flow from the flow passageway 31 into the apparatus by means of a hydraulic pump not shown, and so, the above-described parallel swash plate type pump apparatus can be used as a hydraulic motor.

Figure 4A:
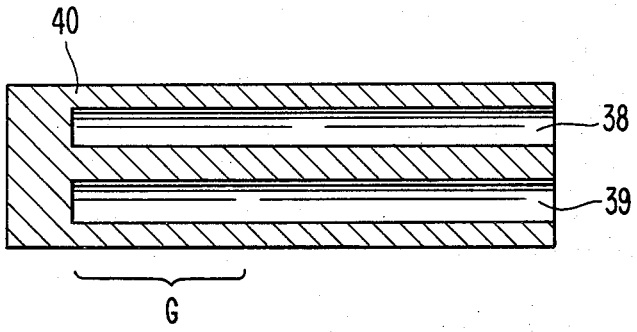
FIG. 4(*a*) illustrates a working process of the valve is a longitudinal cross-sectional view of a valve shaft.
Figure 4B:
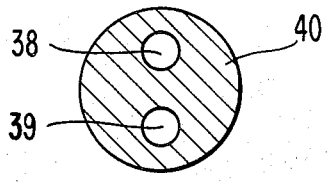
Figure 10:
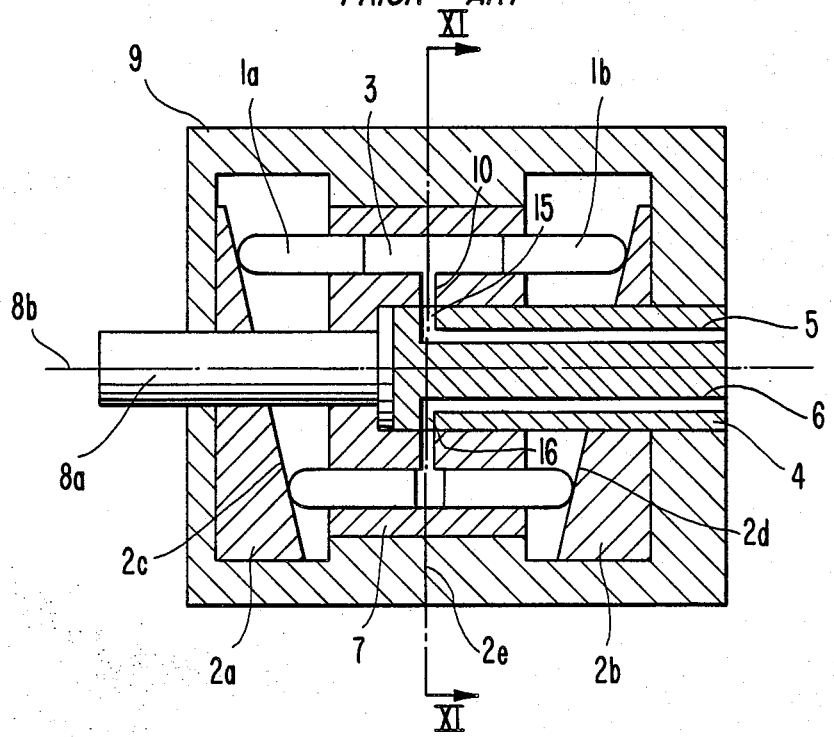
FIG. 10 PRIOR ART
FIG. 10 is a longitudinal cross-sectional view illustrating a nonparallel swash plate pump apparatus in the prior art, and FIG. 11 being a transverse cross-sectional view of a valve shaft taken along line XI—XI in FIG. 10 as viewed in the direction of the arrows.
Figure 11:
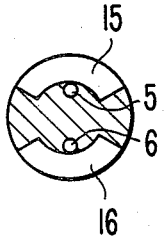
FIG. 11 PRIOR ART

Now, upon manufacturing the valve shaft 27 having the above-mentioned twisted flow passageways 31*a* and 32*a* formed herein, as shown in FIGS. 4(*a*) and 4(*b*) at first two straight flow passageways 38 and 39 are formed in a circular rod 40 to extend in the axial direction and subsequently a circular rod portion G in the proximity of the closed ends of the flow passageways 38 and 39 is twisted by 180° by a plastic working operation.

Then, furthermore, inlet side ports (note reference numerals 35 and 36 in FIGS. 1–3) and outlet side ports (note reference numerals 33 and 34 in FIGS. 1–3) are formed at the opposite ends of the circular rod portion G, and thereby the valve shaft 27 shown in FIGS. 1–3 is completed.

As described above, the valve shaft 27 containing the twisted flow passageways 31*a* and 32*a* therein can be manufactured easily, and manufacture of the above-described parallel swash plate type pump apparatus can be realized reliably without problem.

Modified embodiments of the valve shaft portion in the parallel swash plate type fluid machine according to the present invention now will be described with reference to FIGS. 5 to 8.

Figure 5:
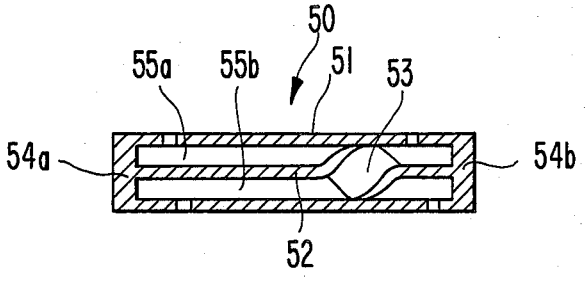
FIG. 5 is a longitudinal cross-sectional view showing a valve shaft having twisted or spiral flow passageways according to another preferred embodiment of the present invention.

In FIG. 5, reference numeral 50 designates a twisted flow passageway shaft, in which a strip-like partition wall 52 having its middle portion twisted and inverted as shown at 53 is accommodated within an outer cylinder 51 having a predetermined diameter so as to extend along the center axis, the opposite ends of the outer cylinder 51 are covered by end plates 54*a* and 54*b*, and twisted space portions 55*a* and 55*b* formed on the opposite sides of the partition wall 52 are used as an inlet flow passageway and an outlet flow passageway.

Manufacture of the above-described twisted flow passageway shaft 50 can be achieved either through a process in which the outer cylinder 51, the strip-like partition wall 52 and the end plates 54*a* and 54*b* are preliminarily manufactured separately and then they are joined, or through a process of manufacturing integrally in a die by casting, and these processes will be explained sequentially in the following.

Figure 6A:
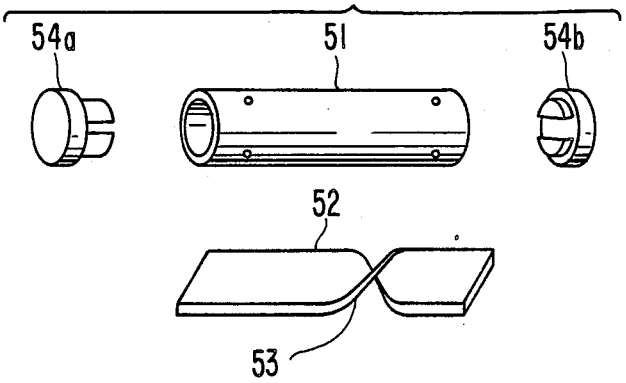
FIGS. 6(A) and 6(B) are schematic perspective and cross-section views, respectively, showing a process for making the valve shaft having twisted flow passageways in FIG. 5 by brazing.
Figure 6B:
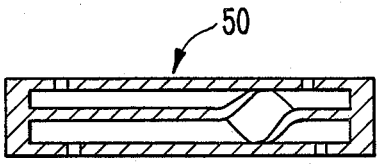
Figure 6B:
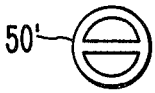

FIGS. 6(A) and 6(B) show a process of manufacture employing joining brazing, in which as shown in FIG. 6(A) the outer cylinder 51, the strip-like partition wall 52 and the end plates 54*a* and 54*b* are separately manufactured, and the strip-like partition wall 52 and the end plates 54*a* and 54*b* are subjected to plating. Then the strip-like partition wall 52 is inserted into the outer cylinder 51, the end plates 54*a* and 54*b* are fitted to the opposite ends of the outer cylinder 51 for assembling, and under that condition the assembly is heated up to a temperature higher than a melting point of the plating metal to achieve joining by brazing. Then the twisted flow passageway shaft 50 shown in FIG. 6(B) is completed.

Next, upon manufacturing the same through diffusion joining, the component parts which are exactly the same as those shown in FIG. 6(A), are preliminarily manufactured, they are assembled similarly to the above-described process but without subjecting the strip-like partition wall and the end plates to plating and heated up to about 1000° C. to cause them to be jointed together by diffusion joining, and then a twisted flow passageway shaft which is similar to that shown in FIG. 6(B) is formed.

Figure 7A:
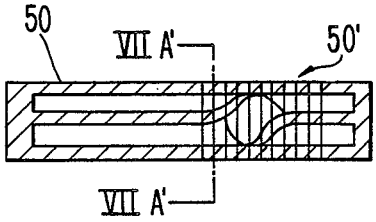
FIGS. 7(A), 7(A') and 7(B) are schematic cross-sectional views view showing a process for making the valve shaft having twisted flow passageways as in FIG. 5 by a stacked diffusion joining process.
Figure 7B:
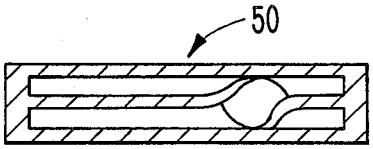

FIGS. 7(A), 7(A′) and 7(B′) shows a manufacturing process employing stacked diffusion joining. In this process, a plurality of rings 50′, as shown in FIG. 7(A′) formed by transversely cutting large number of pieces from a completed nontwisted flow passageway shaft, are preliminarily formed, and then are sequentially rotated and aligned to produce a twisted configuration and then they are stacked and subjected to diffusion joining. Thereby a twisted flow passageway shaft 50 as shown in FIG. 7(B) is formed.

FIGS. 8(A), 8(B) and 8(B′) shown a manufacturing process employing electron beam welding or laser beam welding. In this process, after component parts almost similar to those used in the embodiment shown in FIGS. 6(A) and 6(B) have been produced and assembled as shown in FIG. 8(A), they are welded together at welding portions 50″ shown in FIG. 8(B′) by electron beam welding or laser beam welding, and thereby a twisted passageway shaft 50 is manufactured as shown in FIG. 8(B).

The twisted flow passageway shaft 50 constructed in the above-described manners and shown in FIGS. 5 to 8 is used as a valve shaft in a parallel swash plate type fluid machine as shown in FIG. 1, and in the outer cylinder wall of the twisted flow passageway shaft 50 are provided communicating holes corresponding to the inlet side ports 35 and 36 and the outlet side ports 33 and 34, which communicate the ports 21*a* and 21*b* opening at the inner circumference of the barrel 29 with the above-mentioned twisted space portions 55*a* and 55*b* serving as the inlet flow passageway 31, the outlet flow passageway 32 and the twisted flow passageways 31*a* and 32*a*.

FIG. 9 shows another preferred embodiment of the present invention, in which a plurality of twists are involved. In this illustrated embodiment also, component members similar to those used in the preceding embodiments shown in FIGS. 5 to 8 are employed except for the fact that a strip-like partition wall 62 within an outer cylinder 61 has a plurality of twists 63 In this modified embodiment also, the above-described respective processes for joining can be employed, and a shaft containing flow passageways each having a plurality of twists can be manufactured. In quite the same manner as in the above-described embodiments, the thus manufactured twisted flow passageway shaft is available as a valve shaft in a parallel swash plate type fluid machine.

It is to be noted that while the above-mentioned respective manufacturing processes provide that the respective component parts such as the outer cylinder 51(61), the strip-like partition wall 52(62) and the end plates 54*a*(64*a*), 54*b*(64*b*) are preliminarily produced individually and then they are assembled and joined, it is also possible to manufacture these assembled structures in an integral mold by making use of a casting technique.

As described in detail above, according to the present invention, in a parallel swash plate type fluid machine, in which a plurality of cylinder sections directed in the axial direction and opening respectively on the opposite sides of a barrel are provided in the barrel that is rotatable integrally with a rotary shaft, there are provided pistons fitted in the cylinder sections and capable of projecting respectively on the opposite sides of the barrel, and a pair of swash plates for restraining strokes of the pistons are provided in a mutually parallel condition on the opposite sides of the barrel. An inlet side flow passageway and an outlet side flow passageway for fluid can be constructed in such simple structure that ports communicating with the respective fluid chambers in the plurality of cylinder sections have their inlet sides connected with each other through a twisted flow passageway and have their outlet sides connected with each other through another twisted flow passageway. Accordingly, according to the present invention, vibrations accompanying high speed rotation of the barrel can be greatly reduced, hence not can environmental noise be suppressed, but also working efficiency of the fluid machine can be improved.

Furthermore, according to the present invention, the twisted flow passageways in the above-described fluid machine are constructed in a simple manner such that a strip-like partition wall that is twisted to have an inverted middle portion is accommodated within an outer cylinder to extend in the axial direction, and hollow spaces on the opposite sides of the partition wall are used as an inlet flow passageway and an outlet flow passageway, respectively. Hence, according to the present invention, difficult operations such as drilling twisted bores in a circular rod or twisting a circular rod having preliminarily straight drilled bores becomes necessary, and twisted flow passageways can be manufactured easily and precisely through a joining process such as plating, brazing, diffusion joining, high energy beam welding, etc., or a casting process. Therefore, the present invention is industrially very useful.

While the principle of the present invention has been described above in connection to preferred embodiments of the invention, it is a matter of course that many apparently widely different embodiments of the present invention can be made without departing from the spirit of the invention.

What is claimed is:

1. A parallel swash plate type fluid machine comprising:

a casing;

a barrel within said casing and rotatable integrally with a rotary shaft about a rotary axis;

a pair of swash plates fixed within said casing at opposite axial ends of said barrel, said swash plates having parallel surfaces inclined to said rotary axis;

a plurality of pairs of cylinder sections formed in said barrel at positions equally angularly spaced about said rotary axis, said cylinder sections of each said pair including first and second cylinder sections being axially aligned in a direction parallel to said rotary axis, being axially separated in said direction, and opening on opposite axial ends of said barrel;

pistons slidably mounted in respective said cylinder sections between retracted positions extending into respective said cylinder sections and projected positions extending from respective said cylinder sections, said pistons having outer ends abutting said surfaces of respective said swash plates, such that upon rotation of said barrel about said rotary axis said swash plates result in said pistons in each said pair of cylinder sections together moving in the same direction therein between respective said retracted and projected positions, with the total volume of working chambers unoccupied by said pistons in said each pair of cylinder sections remaining constant;

each said working chamber having opening therein a respective port, said ports of said working chambers of said first cylinder sections being spaced axially of said ports of said working chambers of said second cylinder sections;

a valve shaft fixed to said casing and extending into said barrel coaxial of said rotary axis, said valve shaft having therein separate first and second fluid passageways; and means for connecting said first fluid passageway to all of said ports of those said cylinder sections the pistons of which are in said retracted positions and for connecting said second fluid passageway to all of said ports of those said cylinder sections the pistons of which are in said projected positions, said connecting means comprising, for each said fluid passageway, a first length portion opening onto the outer surface of said valve shaft at a first position and a second length portion opening onto said outer surface of said valve shaft at a second position spaced axially and circumferentially of said first position.

2. A fluid machine as claimed in claim 1, wherein each said fluid passageway includes a portion extending inclined to said rotary axis and connecting said first and second length portions.

3. A fluid machine as claimed in claim 2, wherein said valve shaft comprises an outer cylinder having an interior divided by a strip-like partition into first and second interior portions respectively forming said first and second fluid passageways on opposite sides of said partition, said partition being twisted about said rotary axis.

* * * * *